US007861882B2

(12) United States Patent
Tumolo et al.

(10) Patent No.: US 7,861,882 B2
(45) Date of Patent: Jan. 4, 2011

(54) SEALED DOCKING DEVICE FOR MOBLIE CONTAINERS OF VARIOUS DIAMETERS

(75) Inventors: Luc Tumolo, Le Perray en Yvelines (FR); Pascal Le Chevalier, Cherbourg Octeville (FR)

(73) Assignee: Compagnie Generale des Matieres Nucleaires, Velizy-Villacoublay (FR)

( * ) Notice: Subject to any disclaimer, the term of this patent is extended or adjusted under 35 U.S.C. 154(b) by 1129 days.

(21) Appl. No.: 11/547,385

(22) PCT Filed: Mar. 31, 2005

(86) PCT No.: PCT/FR2005/050204

§ 371 (c)(1),
(2), (4) Date: Oct. 2, 2006

(87) PCT Pub. No.: WO2005/096318

PCT Pub. Date: Oct. 13, 2006

(65) Prior Publication Data

US 2008/0000545 A1 Jan. 3, 2008

(30) Foreign Application Priority Data

Apr. 2, 2004 (FR) ..... 04 50657

(51) Int. Cl.
*B65D 45/00* (2006.01)
*G21F 5/12* (2006.01)

(52) U.S. Cl. ..... 220/328; 250/506.1; 250/507.1; 376/260; 376/272; 414/146

(58) Field of Classification Search ..... 220/328; 376/260, 272; 250/506.1, 507.1; 414/146
See application file for complete search history.

(56) References Cited

U.S. PATENT DOCUMENTS 4,047,632 A * 9/1977 Schilling ..... 376/294
4,704,539 A * 11/1987 Dequesnes et al. ..... 250/506.1
4,975,240 A 12/1990 Lahr et al.
5,287,676 A * 2/1994 Erbse et al. ..... 53/127
5,415,509 A 5/1995 Martin et al.

FOREIGN PATENT DOCUMENTS

ES 2056018 10/1993

OTHER PUBLICATIONS

XP-002296605, 1994, WPI/Derwent.

* cited by examiner

*Primary Examiner*—Jack I Berman
(74) *Attorney, Agent, or Firm*—Nixon Peabody LLP

(57) ABSTRACT

The invention relates to a device for the sealed docking (14) of mobile containers (42) equipped with plugs (44) of various diameters on a containment box (10). The device includes a center disk (22) and at least one docking flange (20*a*, 20*b*, 20*c*) that are concentric to each other, normally plugging the access opening (18) of the containment box. A locking/unlocking mechanism (24) makes it possible to only unlock the center disk (22) alone or the center disk and one or more of the docking flanges (20*a*, 20*b*, 20*c*), according to the diameter of the plug (44). This arrangement makes it possible, in particular, to clean the plug (44) of a mobile container (42) serving to transport contaminated nuclear equipment.

9 Claims, 4 Drawing Sheets

SEALED DOCKING DEVICE FOR MOBLIE CONTAINERS OF VARIOUS DIAMETERS

CROSS-REFERENCE TO RELATED APPLICATION

This application claims priority based on International Patent Application No. PCT/FR2005/050204 filed on Mar. 31, 2005, entitled "Sealed Docking Device for Mobile Containers of Various Diameters" by Luc Tumolo and Pascal Le Chevalier, which claims priority of French Application No. 04 50657, filed on Apr. 2, 2004, and which was not published in English.

TECHNICAL FIELD

This invention relates to a device that enables mobile containers equipped with docking systems of the same design but of various diameters to be docked in a sealed manner on a containment box.

In particular, a device such as this can be used to equip a containment box intended for remote servicing of mobile containers, such as containers used to provide for transport of contaminated nuclear equipment to an unloading unit in which this equipment can be repaired or conditioned as waste.

STATE OF THE PRIOR ART

In nuclear facilities, mobile containers are used to carry out the replacement of contaminated equipment. More precisely, the contaminated equipment is placed inside mobile containers by means of which it is transported to unloading units. The contaminated equipment can be conditioned in these units as waste or undergo appropriate repairs.

The mobile containers are equipped with a sealed docking system that makes it possible to ensure leak tightness during replacement and disposal of a piece of equipment. This sealed docking system is closed with a plug during transport of the contaminated equipment to the unloading unit. The upper portion of this plug is very highly contaminated by this equipment.

In existing facilities, servicing of the mobile containers is ensured by placing them inside a protective vinyl bag and by inserting them through an airlock into a decontamination cell. The plugs of the mobile containers are decontaminated inside said cell by operators that are outfitted with sealed suits and whose holding time is monitored.

DESCRIPTION OF THE INVENTION

The object of the invention is a device that enables mobile containers equipped with docking systems of the same design but of various diameters to be docked in a sealed manner on a containment box, so as to be able to carry out the cleaning operations of the plug remotely, inside the containment box, the latter likewise ensuring the protection of the operators against radiation.

According to the invention, this problem is solved by means of a device for the sealed docking of mobile containers equipped with plugs of various diameters on a containment box having a counter flange through which a circular access opening passes, characterized in that it includes:

at least one docking flange and one center disk, concentric to each other, capable of being placed one inside the other inside the access opening of the counter flange, the outside diameters of the center disk and of each docking flange corresponding to those of the plugs;

locking/unlocking means for successively unlocking the center disk and each docking flange, by moving outwardly, and for successively locking each docking flange and the center disk, by moving inwardly, in relation to said access opening.

This arrangement makes it possible to dock mobile containers of various sizes on the containment box. As a matter of fact, the particular design of the locking/unlocking means makes it possible to remove only the center disk, in the case of a container equipped with a small-diameter plug, or to additionally remove one or more docking flanges when the containers are closed with larger-diameter plugs.

According to a preferred embodiment of the invention, the device also includes as many centering caps of various diameters as there are plug diameters, a cap having a diameter corresponding to that of the plug of the mobile container to be docked being fastened onto the containment box. In this case, a cap having dimensions suited to the diameter of the plug is fastened to the counter flange before docking the mobile container on the containment box. This cap makes it possible to ensure that the mobile container is correctly centered in relation to the opening in the counter flange.

In the preferred embodiment of the invention, each centering cap advantageously includes unlocking limitation means, prohibiting the locking/unlocking means from unlocking each docking flange having an inside diameter larger than the diameter of the plug of the mobile container. Owing to this arrangement, the unlocking operation concerns only the disk and, possibly, the docking flange or flanges whose inside diameter corresponds to the diameter of the plug.

According to another feature of the invention, the locking/unlocking means include a plate capable of rotating on the counter flange, as many pairs of cams being formed on said plate as there are plug diameters, a strike plate being engaged with each of the cams so as to move between a locking position and an unlocking position when the plate is rotated.

The unlocking limitation means advantageously include a pin, associated with the rotating plate and lodged inside of a notch of limited circumferential length, formed in the centering cap.

In the latter case, the locking/unlocking means more preferably include a spindle which passes through the counter flange and means of controlling the rotation of said spindle, the latter being engaged with a first sector gear formed on the plate and with a second sector gear formed on a cap holding the pin.

Additionally, a floating bearing ring is preferably mounted inside of each of the centering caps.

In the preferred embodiment of the invention, the counter flange is mounted on an upper wall of the containment box and the latter contains a platform on which the docking flange and the center disk rest, control means making it possible to move the platform between a high position for holding the docking flange and the center disk inside of said opening, irrespective of the status of the locking/unlocking means, and a low position allowing the plug to be cleaned.

In a preferred application of the invention, the containment box thus contains means for cleaning the plug remotely.

BRIEF DESCRIPTION OF THE DRAWINGS

A preferred embodiment of the invention will now be described, for non-limiting, illustrative purposes, with reference to the appended drawings in which.

DETAILED DESCRIPTION OF A PREFERRED EMBODIMENT

Figure 1:
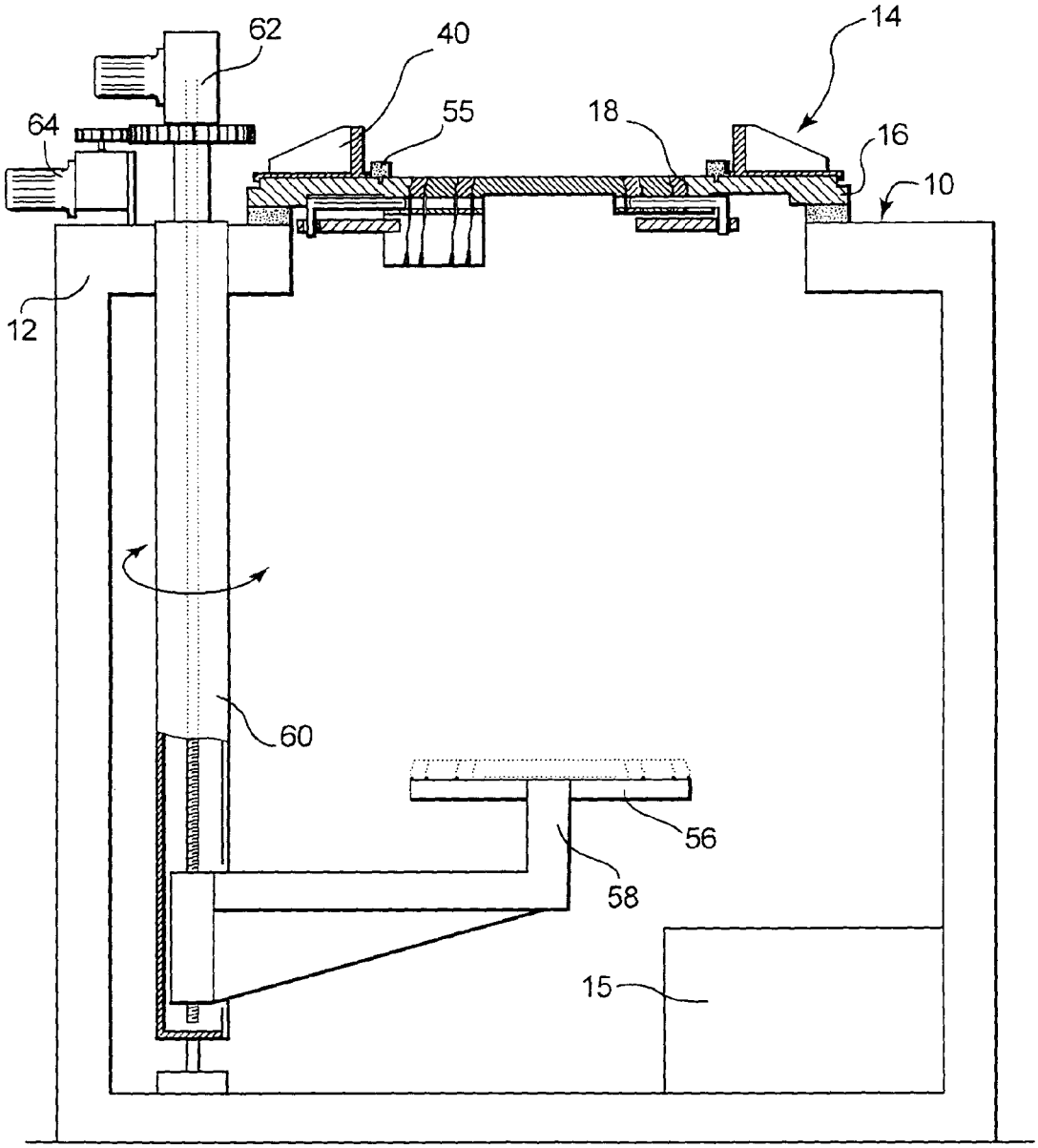
FIG. 1 is a cross-sectional side view which schematically shows a containment box whose upper wall is equipped with a sealed docking device in accordance with the invention.

FIG. 1 is a schematic representation of a containment box 10 servicing a nuclear facility.

The containment box 10 is equipped with a sealed docking device 14 made in accordance with the invention. In the embodiment shown for non-limiting illustrative purposes, the sealed docking device 14 is built into the upper horizontal wall 12 of the containment box. Alternatively, this same device could be built into any other wall of the containment box, without exceeding the scope of the invention.

The sealed docking device 14, which will be described in detail below, is designed to enable a leak-proof connection of mobile containers 42 of various sizes with the containment box 10. More precisely, the sealed docking device 14 is designed to enable the docking of mobile containers 42 having the same design, but equipped with plugs 44 of different diameters.

When the docking operation is completed, the facility shown in FIG. 1 may in particular make it possible to clean the upper surface 44*a* (FIG. 2) and the peripheral surfaces of the plug 44, which closes the mobile container 42, thanks to remote cleaning means 15 located inside the containment box 10. It is likewise possible to ensure the cleaning, servicing or monitoring of the equipment situated inside the container, or else the cleaning of the container itself. The containment box 10 thus ensures the protection of the operators against radiation.

Figure 2:
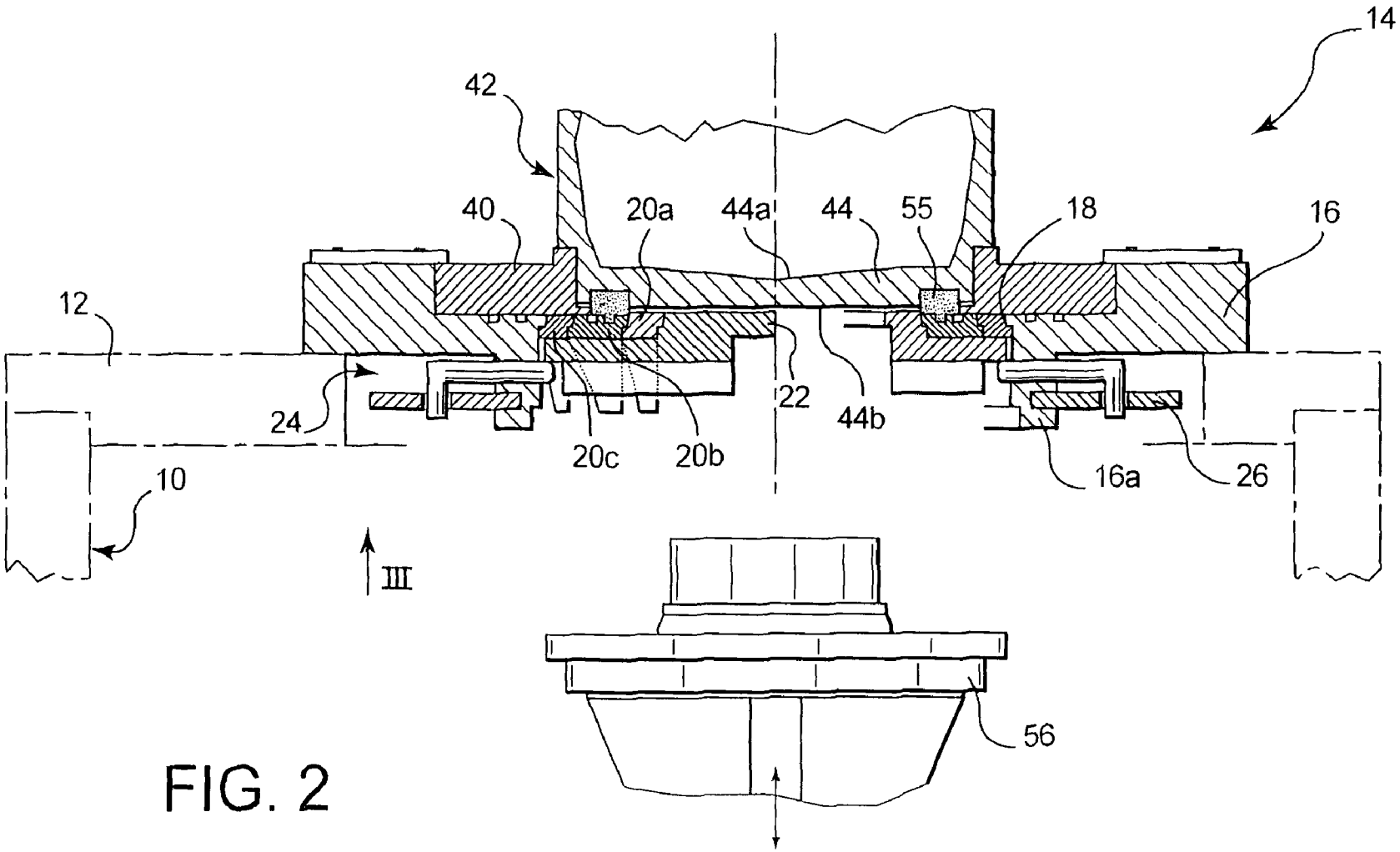
FIG. 2 is a cross-sectional side view which shows the sealed docking device according to the invention, at a larger scale.
Figure 3:
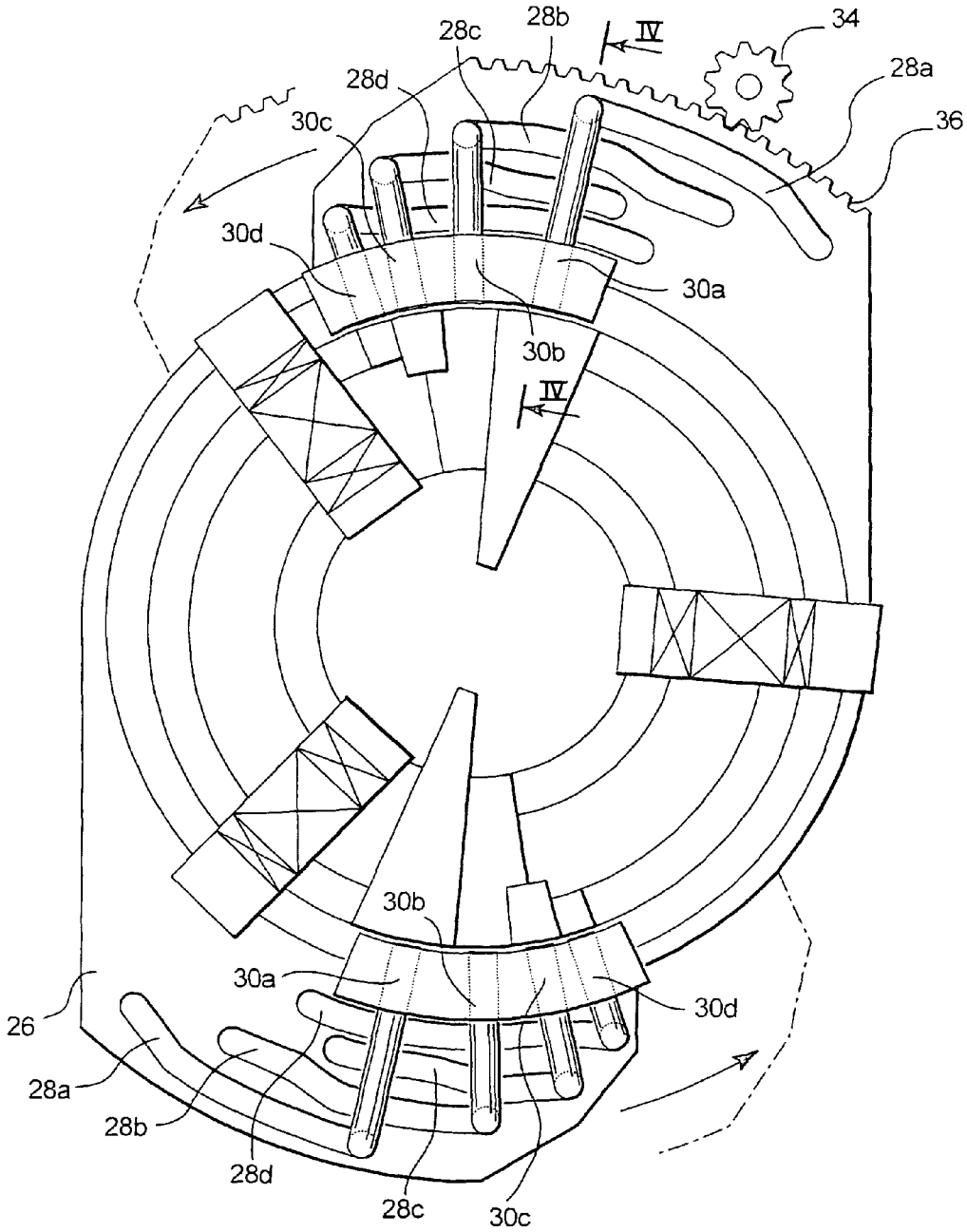
FIG. 3 is a bottom view, taken in the direction of the arrow III of FIG. 2.
Figure 4:
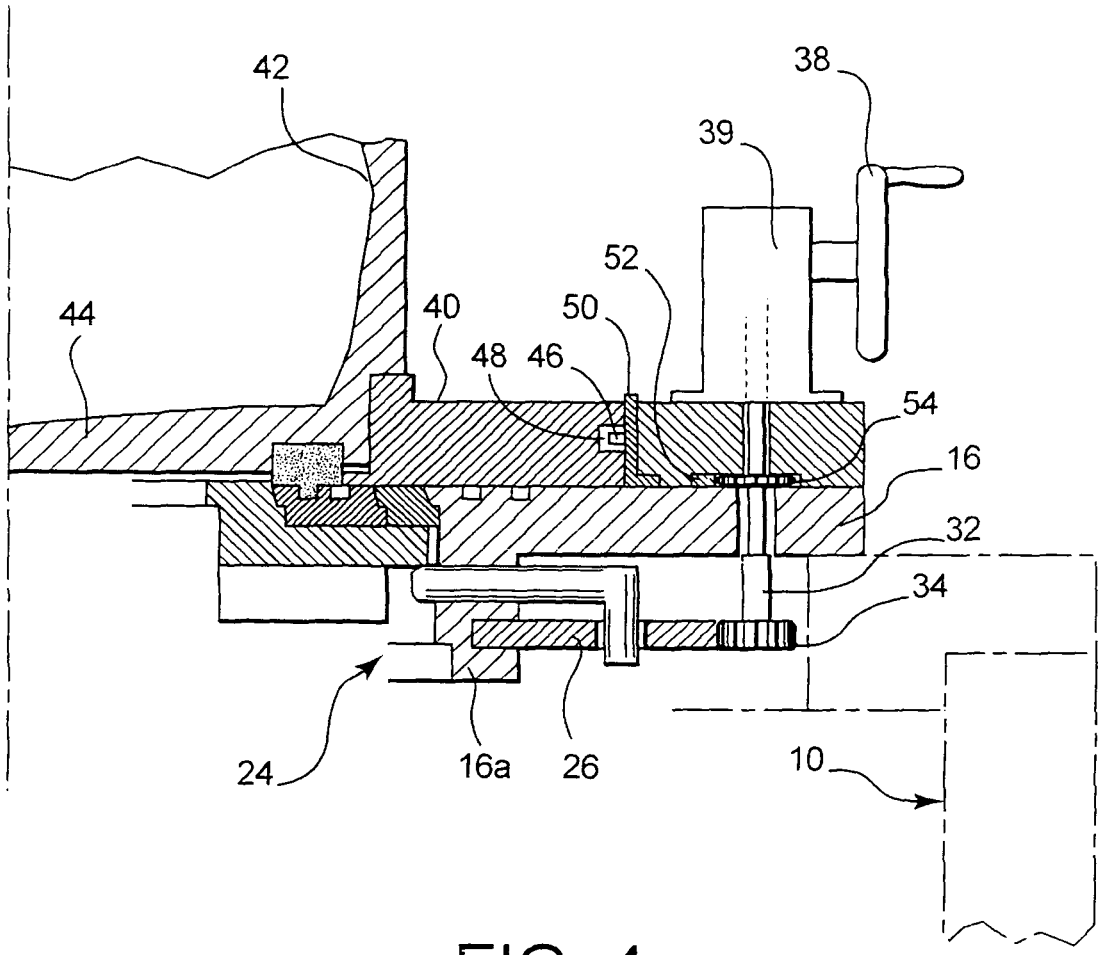
FIG. 4 is a sectional view along line IV-IV of FIG. 3.

As shown more precisely in FIGS. 2 to 4, the sealed docking device 14 according to the invention includes a counter flange 16. In the embodiment shown, this counter flange 16 is fastened in a leak-proof manner to the upper horizontal wall 12 of the containment box 10. It delimits a circular access opening 18.

In accordance with the invention, the sealed docking device 14 first and foremost includes at least one docking flange (three, in the embodiment shown, designated by the reference numbers 20*a*, 20*b* and 20*c*) and one center disk 22, which are concentric to each other. The docking flanges 20*a*, 20*b* and 20*c* are ring-shaped and are capable of being mounted one inside the other, along with the center disk 22, inside the circular access opening 18 formed in the counter flange 16. They then seal said access opening in a leak-proof manner, in the horizontal plane of the counter flange 16.

It is to be noted that the peripheral edges of the inside of the access opening 18, the outside of the center disk 22 and the inside and outside of the docking flanges 20*a*, 20*b* and 20*c* have complementary shapes such that each docking flange as well as the center disk can be freely moved towards the interior of the containment box, i.e., downwardly, in relation to the docking flange or to the counter flange that surrounds it contiguously. On the other hand, any movement in the opposite direction, i.e., outward or upward, is impossible.

As will be better understood below, the number of docking flanges 20*a*, 20*b* and 20*c* that surround the center disk 22 depends on the number of different types of mobile containers 42 that one wishes to be able to dock on the containment box 10. More precisely, if one wishes to be able to dock on the containment box 10 mobile containers 42 whose plugs 44 have n different diameters, a sealed docking device 14 including n−1 docking flanges will be used. In the embodiment shown, where the sealed docking device 14 includes three docking flanges 20*a*, 20*b* and 20*c*, mobile containers 42 equipped with plugs 44 having four different diameters can thus be docked.

The sealed docking device 14 according to the invention additionally includes locking/unlocking means 24. By moving outwardly, these locking/unlocking means 24 have the primary function of successively unlocking the center disk 22 and each of the docking flanges 20*a*, 20*b* and 20*c*. This characteristic makes it possible to unlock only the center disk 22, when the plug of the mobile container previously docked on the containment box has the smallest possible diameter, or to unlock only the center disk 22 and the docking flange or flanges 20*a*, 20*b* and 20*c* which overlap the bottom surface 44*b* of the plug of the mobile container docked on the containment box.

The locking/unlocking means 24 are mounted on the counter flange 16 so as to be capable of being operated from the outside of the containment box 10.

In the embodiment shown in FIGS. 2 to 4, the locking/unlocking means 24 include a flat horizontal plate 26, supported by the counter flange 16 so as to be able to rotate freely about the vertical axis of the circular access opening 18. More precisely, the plate 26 is rotatably mounted on a tubular center portion 16*a* of the counter flange 16, which protrudes downwardly inside the containment box 10.

The plate 26 comprises as many pairs of cams 28*a*, 28*b*, 28*c* and 28*d* as there are different plug 44 diameters on the mobile containers 42 that one wishes to be able to dock on the containment box 10. In other words, if the plugs of the mobile containers to be docked have n different diameters, the plate 26 comprises n pairs of cams. In the embodiment shown, as already mentioned, the number n is equal to four.

The cams of each pair of cams 28*a*, 28*b*, 28*c* and 28*d* are situated at diametrically opposed locations in relation to the vertical axis of the circular access opening 18.

In the embodiment shown in FIGS. 2 to 4, the cams 28*a*, 28*b*, 28*c* and 28*d* consist of slots that run through the entire thickness of the plate 26.

The cams 28*d* closest to the axis of the opening 18 successively include, in a clockwise direction, an end portion slanted towards said axis and a main arc of circle-shaped portion centered on said axis.

The cams 28*c* immediately adjacent to cams 28*d* successively include, in a clockwise direction, a first arc of circle-shaped portion centered on the axis of the opening 18, an intermediate portion slanted towards said axis and a third arc of circle-shaped portion centered on said axis and having a smaller diameter than the first portion.

The cams 28*b* immediately adjacent to cams 28*c* successively include, in a clockwise direction, a first arc of circle-shaped portion centered on the axis of the opening 18, an intermediate portion slanted towards said axis and a third arc of circle-shaped portion centered on said axis and having a smaller diameter than the first part.

Finally, the cams 28*a* most distant from the axis of the opening 18 successively include, in a clockwise direction, a main arc of circle-shaped portion centered on the axis of the opening 18 and an end portion slanted towards said axis.

The cams 28*d*, 28*c*, 28*b* and 28*a* are angularly offset, in a clockwise direction, moving away from the axis of the opening 18, as shown in FIG. 3.

The locking/unlocking means 24 additionally include as many pairs of strike plates 30*a*, 30*b*, 30*c* and 30*d* as there are cams 28*a*, 28*b*, 28*c* and 28*d*. More precisely, one strike plate

30*a*, 30*b*, 30*c* and 30*d* is engaged with each of the cams 28*a*, 28*b*, 28*c* and 28*d*, so as to be able to move between a locking position and an unlocking position, when the plate 26 is rotated about the axis of the opening 18.

In the embodiment shown in the figures, each of the strike plates 30*a*, 30*b*, 30*c* and 30*d* has a substantially L-shape comprising a small arm oriented parallel to the axis of the opening 18 and a large arm oriented in a direction perpendicular and secant to said axis.

The small arm of each of the strike plates 30*a*, 30*b*, 30*c* and 30*d* passes through the slot consisting of the cam 28*a*, 28*b*, 28*c* and 28*d* which corresponds to it, with the result being that each of the strike plates is engaged with one of the cams. The large arm of each of the strike plates 30*a*, 30*b*, 30*c* and 30*d* is slidably mounted in a hole provided for this purpose in the tubular center portion 16*a* of the counter flange 16.

The holes in which the strike plates 30*a*, 30*b*, 30*c* and 30*d* are lodged are angularly offset in the same way as the cams 28*a*, 28*b*, 28*c* and 28*d* supported by the plate 26. Consequently, all of the small arms of the strike plates 30*a*, 30*b*, 30*c* and 30*d* are simultaneously placed at the front end, the center portion or rear end of the corresponding cams, in a clockwise manner, according to the angular position of the plate 26.

In the angular position of the plate 26 shown in FIG. 3, the small arms of the strike plates 30*a*, 30*b*, 30*c* and 30*d* are all placed at the rear end of the corresponding cams 28*a*, 28*b*, 28*c* and 28*d*, in a clockwise manner. All of the strike plates 30*a*, 30*b*, 30*c* and 30*d* are then situated in their unlocking position. As a matter of fact, the ends of the large arms of the strike plates 30*a*, 30*b*, 30*c* and 30*d* are completely retracted into the holes formed in the tubular center portion 16*a* of the counter flange 16.

In the opposite angular position (not shown) of the plate 26, the small arms of the strike plates 30*a*, 30*b*, 30*c* and 30*d* are all placed at the front end of the corresponding cams 28*a*, 28*b*, 28*c* and 28*d*, in a clockwise manner. All of the strike plates 30*a*, 30*b*, 30*c* and 30*d* are then situated in their locking position. As a matter of fact, the ends of the large arms of the strike plates 30*a*, 30*b*, 30*c* and 30*d* protrude inside of the center portion of the counter flange 16.

The arrangement just described makes it possible to control a successive movement of each of the strike plates 30*d*, 30*c*, 30*b* and 30*a* towards the axis of the opening 18 when the plate 26 is rotated in a counter clockwise direction, starting at the completely locked position shown in FIG. 3. This direction of rotation of the plate 26 thus has the effect of moving one or more of the strike plates 30*d*, 30*c*, 30*b* and 30*a* from their initial unlocked position into their locking position, according to the angle of rotation of the plate 26.

Conversely, this arrangement makes it possible to control a successive movement of each of the pairs of strike plates 30*a*, 30*b*, 30*c* and 30*d* while moving away from the axis of the opening 18, when the plate 26 is rotated in a clockwise direction, starting at the completely locked position opposite the one shown in FIG. 3. This direction of rotation of the plate 26 thus has the effect of moving one or more of the pairs of strike plates 30*a*, 30*b*, 30*c* and 30*d* from their initial locked position into their unlocking position, according to the angle of rotation of the plate 26.

As shown more precisely in FIGS. 2 and 3, each of the docking flanges 20*a*, 20*b* and 20*c* as well as the center disk 22 include a pair of diametrically opposed protrusions on their bottom face turned towards the interior of the containment box 10. More precisely, the protrusions formed on each of these parts are shaped such that they extend away from the axis of the opening 18, at locations that are offset angularly from one part to another. These protrusions formed on the docking flanges 20*a*, 20*b* and 20*c* and on the center disk 22 are therefore flush with the inside surface of the tubular center portion 16*a* of the counter flange 16, immediately above one of the corresponding pairs of strike plates 30*a*, 30*b*, 30*c* and 30*d*.

When the docking flanges 20*a*, 20*b* and 20*c* and the center disk 22 are placed inside the opening 18, the bottom faces of the aforesaid protrusions are situated at the same level as the top faces of the large arms of the strike plates 30*a*, 30*b*, 30*c* and 30*d*. As a result, it becomes impossible for the center disk 22, the docking flange 20*a* adjacent to said disk, the docking flange 20*b* adjacent to the latter and the outside docking flange 20*c* to slip towards the interior of the containment box 10, in as much as the strike plates 30*a*, 30*b*, 30*c* and 30*d* are in locked position.

The protrusions formed on each of the parts consisting of the docking flanges 20*a*, 20*b* and 20*c* and the center disk 22 also have the effect of making it impossible to open any of the docking flanges 20*a*, 20*b* and 20*c* when the center disk 22 is in place, impossible to open any of the docking flanges 20*b* and 20*c* when the inside docking flange 20*a* is in place, and impossible to open the outside docking flange 20*c* when the intermediate docking flange 20*b* is in place.

In the embodiment shown for illustrative purposes in FIGS. 3 and 4, the locking/unlocking means 14 additionally include a vertical control pin 32 which passes through the counter flange 16 in a leak-proof manner, while at the same time being able to freely rotate thereabout. In its portion situated inside the containment box 10, beneath the counter flange 16, the control pin 32 holds a pinion 34 which is engaged with a sector gear 36 formed on a peripheral edge of the plate 26.

In its portion situated outside the containment box 10, above the counter flange 16, the control pin 32 is engaged with control means. In the embodiment shown for illustrative purposes, these control means consist of a crank 38 capable of being operated manually. The crank 38 is mechanically connected to the pin 32 by a bell crankcase 39. Alternatively, other control means, such as a motor or the like, may also be used, without exceeding the scope of the invention.

In the preferred embodiment of the invention shown in the figures, the sealed docking device 14 likewise includes centering caps 40. More precisely, the device includes as many centering caps 40 of different diameters as there are plug 44 diameters among the mobile containers 42 capable of being docked on the containment box 10.

As illustrated more particularly in FIGS. 2 and 4, the centering cap 40, whose diameter corresponds to that of the plug 44 of the mobile container 42 being docked, is fastened onto the face of the counter flange 16 turned towards the exterior of the containment box 10, i.e., upwardly. This attachment is produced by any appropriate means (screws, bolts, etc.), so that the centering cap 40 is centered on the axis of the circular opening 18 formed in the counter flange 16.

As seen, in particular, in FIGS. 2 and 4, the centering cap 40 is chosen so that its inside diameter is equal to the outside diameter of the mobile container 42 being docked, in the area of the latter that surrounds its plug 44.

In the preferred embodiment of the invention shown in the figures, each centering cap 40 incorporates unlocking limitation means. These unlocking limitation means have the function of prohibiting the locking/unlocking means 24 from unlocking the docking flange or flanges 20*a*, 20*b* and 20*c* which have an inside diameter larger than the diameter of the plug 44 of the mobile container 42 being docked. Any risk is thereby eliminated that the docking flanges having diameters larger than that of the plug might be accidentally removed.

As shown, in particular, in FIG. 4, the unlocking limitation means may, in particular, include a pin 46, connected to the rotating plate 26, and a notch 48 formed in the centering cap 40 and in which the pin 46 is lodged.

More precisely, the pin 46 is integral with a ring 50 supported by the counter flange 16 so as to be able to rotate freely about the axis of the circular opening 18. The ring 50 is mounted on the outside of the counter flange 16, around the centering cap 40, and the pin 46 protrudes into the ring 50.

Furthermore, the notch 48 is formed on the outside peripheral surface of the centering cap 40 and has a limited circumferential length. Thus, the angular displacement of the ring 50 is limited by the circumferential length of the notch 48 in which the pin is lodged 46.

On its outside periphery, the ring 50 comprises a gear sector 52. A second pinion 54 fastened to the control pin 32 is engaged with the sector gear 52. Activation of the control means consisting of the crank 38 thus has the effect of simultaneously rotating the plate 26 and the ring 50 in the same direction. The angle of rotation of the plate 26 is thus limited by the abutment of the pin 46 against one or the other of the ends of the notch 48, depending on the direction of said rotation.

Consequently, when the control pin 32 is operated in the unlocking direction, only the center disk 22 and the docking flange or flanges 20*a*, 20*b* and 20*c*, whose strike plates 30*a*, 30*b*, 30*c* and 30*d* are moved away from the axis of the circular access opening 18 as a result of the thus limited rotation of the plate 26, are unlocked.

When the control pin 32 is then operated in the locking direction, the center disk 22 and the previously unlocked docking flange or flanges 20*a*, 20*b* and 20*c* are once again locked as a result of the movement of the corresponding strike plates 30*a*, 30*b*, 30*c* and 30*d* towards the axis of the circular access opening 18.

In the preferred embodiment shown in the figures, the sealed docking device 14 additionally includes as many floating bearing rings of various diameters as there are plug 44 diameters. More precisely, a floating bearing ring 55, whose diameter corresponds to that of the plug 44 of the mobile container 42 being docked, is mounted inside each of the centering caps 40, on the exterior of the containment box 10.

When the counter flange 16 is mounted on the upper horizontal wall of the containment box 10, as illustrated, in particular, in FIG. 1, a horizontal platform 56 is advantageously placed inside the containment box, under the circular access opening 18. This platform 56 is mounted at the end of an arm 58 whose opposite end is capable of sliding along a vertical guide rail 60, as a result of the action of a motor 62. Another motor 64 makes it possible to rotate the rail 60 about its vertical axis. The motors 62 and 64 are placed outside of the containment box 10.

The arrangement just described consists of an elevator capable of moving the platform 56 between a high position and a low position.

In its high position, the platform 56 is flush with the center disk 22 and the docking flanges 20*a*, 20*b* and 20*c*. It thus holds these parts in their positions for closing off the circular access opening 18, even if one or more of them are unlocked.

When the platform 56 is lowered, it takes with it the center disk 22 and the docking flange or flanges 20*a*, 20*b* and 20*c*, when one or more of these parts are unlocked. It is thereby possible to release the bottom face of the plug 44 from the mobile container 42 previously docked on the containment box 10, over a diameter corresponding exactly to the diameter of said plug. As a matter of fact, the sealed docking device 14 according to the invention makes it possible to only unlock the center disk 22 alone, the center disk 22 and the immediately adjacent docking flange 20*a*, the center disk 22 and the two closest docking flanges 20*a* and 20*b*, or else the center disk 22 and the three docking flanges 20*a*, 20*b* and 20*c*, depending on the diameter of the plug 44 of the mobile container 42 previously docked on the containment box 10.

When the sealed docking device 14 includes unlocking limitation means built into the centering cap 40 fastened onto the counter flange 16 as described above, unlocking of the docking flanges 20*a*, 20*b* and 20*c* is automatically prevented or limited to the flange or flanges the opening of which is indispensable in order to release the bottom face of the plug 44 from the mobile container docked on the containment box.

When the bottom face of the plug 44 is thus released, the means 15 for cleaning said plug remotely are actuated. These remote cleaning means may, in particular, consist of conventional nuclear decontamination means known by those skilled in the art.

Of course, the invention is not limited to the embodiment just described for illustrative purposes, but encompasses all variants thereof. Thus, it shall be understood, in particular, that the sealed docking device according to the invention may be used for applications other than the cleaning of the plug of the mobile container docked on the containment box. Furthermore, the use of centering caps and floating bearing rings is not indispensable to the implementation of the invention, in its broadest definition.

The invention claimed is:

1. Device for the sealed docking of mobile containers equipped with plugs of various diameters on a containment box having a counter flange through which a circular access opening passes, wherein said device includes:

at least one docking flange and one center disk, concentric to each other, capable of being placed one inside the other inside the access opening of the counter flange, the outside diameters of the center disk and of each docking flange corresponding to those of the plugs;

locking/unlocking means for successively unlocking the center disk and each docking flange, by moving outwardly, and for successively locking each docking flange and the center disk, by moving inwardly, in relation to said access opening.

2. Sealed docking device as claimed in claim 1, also including as many centering caps of various diameters as there are plug diameters, one centering cap having a diameter corresponding to that of the plug of the mobile container to be docked being fastened onto the containment box.

3. Sealed docking device as claimed in claim 2, in which each centering cap includes unlocking limitation means, prohibiting the locking/unlocking means from unlocking each docking flange having an inside diameter larger than the diameter of the plug of the mobile container.

4. Device as claimed in claim 3, in which the locking/unlocking means include a plate capable of rotating on the counter flange, as many pairs of cams being formed on said plate as there are plug diameters, a strike plate being engaged with each of the cams so as to move between a locking position and an unlocking position when the plate is rotated.

5. Device as claimed in claim 4, in which the unlocking limitation means include a pin, associated with the rotating plate and lodged inside of a notch of limited circumferential length, formed in the centering cap.

6. Device as claimed in claim 5, in which the locking/unlocking means include a spindle which passes through the counter flange and means of controlling the rotation of said spindle, the latter being engaged with a first sector gear formed on the plate and with a second sector gear formed on a ring holding the pin.

7. Device as claimed in any claim 2, in which a floating bearing ring is mounted inside of each of the centering caps.

8. Device as claimed in claim 1, in which the counter flange is mounted on an upper wall of the containment box and the latter contains a platform on which the docking flange and the center disk rest, control means making it possible to move the platform between a high position for holding the docking flange and the center disk inside of said opening, irrespective of the status of the locking/unlocking means, and a low position allowing the plug to be cleaned.

9. Device as claimed in claim 8, in which the containment box contains means for cleaning the plug remotely.

* * * * *